US006295788B2

(12) United States Patent
Reichert

(10) Patent No.: US 6,295,788 B2
(45) Date of Patent: Oct. 2, 2001

(54) INSERT FOR GLAZING UNIT

(75) Inventor: Gerhard Reichert, New Philadelphia, OH (US)

(73) Assignee: Edgetech I.G., Inc., Cambridge, OH (US)

( * ) Notice: Subject to any disclaimer, the term of this patent is extended or adjusted under 35 U.S.C. 154(b) by 0 days.

(21) Appl. No.: 09/761,498

(22) Filed: Jan. 16, 2001

Related U.S. Application Data

(62) Division of application No. 09/126,998, filed on Jul. 31, 1998.

(51) Int. Cl.[7] ..... E06B 3/66

(52) U.S. Cl. ..... 52/786.13; 52/172; 52/204.5; 52/204.595

(58) Field of Search ..... 52/171.3, 172, 52/204.5, 204.591, 204.595, 204.597, 786.13

(56) References Cited

U.S. PATENT DOCUMENTS

| | | | | |
|---|---|---|---|---|
| 3,267,569 | * | 8/1966 | Eichhorn et al. | 52/786.13 X |
| 4,838,006 | * | 6/1989 | Grosch | 52/786.13 |
| 5,209,034 | * | 5/1993 | Box et al. | 52/790.1 X |
| 5,424,111 | * | 6/1995 | Farbstein | 52/790.1 |
| 5,485,710 | * | 1/1996 | Lafond | 52/204.593 |
| 5,498,451 | * | 3/1996 | Lafond | 52/786.13 X |
| 5,501,013 | * | 3/1996 | Misera et al. | 52/786.13 |
| 5,553,440 | * | 9/1996 | Bulger et al. | 52/786.1 X |
| 5,601,677 | * | 2/1997 | Leoplold | 52/786.13 |
| 5,616,415 | * | 4/1997 | Lafond | 52/172 |
| 5,644,894 | * | 7/1997 | Hudson | 52/786.13 |
| 5,759,665 | * | 6/1998 | Lafond | 428/156 |

FOREIGN PATENT DOCUMENTS

| | | | | |
|---|---|---|---|---|
| 630993 | * | 7/1982 | (CH) | 52/786.13 |

* cited by examiner

*Primary Examiner*—Richard Chilcot
(74) *Attorney, Agent, or Firm*—Sand & Sebolt

(57) ABSTRACT

An insert for a glazing unit includes a body having a width and a height. The insert is configured to fit within the spacer of the glazing unit. A typical glazing unit has at least two outer glazing sheets separated by a substantially rigid, U-shaped spacer disposed about the perimeter of the sheets to create an interior cavity between the outer sheets and the spacer. The width and height of the body of the insert are adapted to allow the insert to fit within the U-shaped spacer. The spacer has a longitudinal length dimension substantially equal to the perimeter of the glazing sheets. The body of the insert also has a longitudinal length dimension substantially equal to the length of the spacer. The body of the insert is fabricated from a non-flowable material having substantially stable dimensions. In one embodiment of the invention, the insert includes an inwardly facing, intermediate glazing sheet-receiving channel that is adapted to slidably receive and position an intermediate glazing sheet.

28 Claims, 10 Drawing Sheets

INSERT FOR GLAZING UNIT

CROSS-REFERENCE TO RELATED APPLICATION

This application is a divisional application based on U.S. patent application Ser. No. 09/126,998 filed Jul. 31, 1998 titled Insert for Glazing Unit; the disclosures of which are incorporated herein by reference.

BACKGROUND OF THE INVENTION

1. Technical Field

This invention relates to multiple-pane glazing units. More particularly, this invention relates to glazing units and methods for forming glazing units having a substantially U-shaped moisture and gas impervious spacer. Specifically, this invention relates to an insert that is adapted to fit within the U-shaped spacer in multiple-pane glazing units.

2. Background Information

Multiple-pane glazing units are used to increase the energy efficiency of houses and other buildings. A multiple-pane glazing unit includes a pair of outer glazing sheets spaced apart by a spacer disposed about the perimeter of the glazing sheets. The two glazing sheets cooperate with the spacer to form an insulating sealed air cavity. This cavity may be filled with an inert gas having a lower conductivity than air to improve the insulating properties of the multiple-pane sealed glazing unit. One or more intermediate glazing sheets may be held by the edge assembly in a substantially parallel relation to the outer glazing sheets. The intermediate glazing sheet divides the single cavity into a pair of cavities to add a further layer of insulation between the outside atmosphere and the inside atmosphere.

Although some windows may be manufactured in advance in standard sizes, a large portion of the insulating glass industry is devoted to custom manufacturing. Custom-sized glazing units may be made by hand in small-scale operations by cutting the glazing sheets to size and manually positioning the edge assemblies about their perimeters. Automated machinery has, however, developed in recent times that substantially decreases the amount of time required to fabricate a custom-sized glazing unit. Such automated machines are expensive and thus force a company to use the machine for many years to justify its purchase.

A glazing unit that can be produced by one such automated process is described in U.S. Pat. No. 5,531,047 to Leopold et al. The glazing unit disclosed in this patent includes a pair of outer glazing sheets secured to the outer legs of a spacer having a generally U-shaped cross section. On the interior face of the spacer between the outer legs, a layer of pliable material having a desiccant material therein is provided. This combination is known as a desiccant matrix. The edge of a third or intermediate glazing sheet is disposed in a groove formed in the layer of pliable material. Movement of the intermediate sheet is limited by the cooperation of the layer of the pliable material and a portion of the outer legs of the spacer at the corners of the unit which are bent inwardly to move the layer of pliable material at the corner toward the intermediate sheet during fabrication of the unit.

Although the glazing unit and method of manufacturing the glazing unit disclosed in U.S. Pat. No. 5,531,047 meet the objectives of that patent, there are certain disadvantages to the product and method. One problem with the glazing unit is that the pliable material in the spacer may be seen through the glazing sheets. Such visibility degrades the appearance of the glazing unit. It is thus desired in the art to provide a glazing unit similar to that disclosed in patent 5,531,047 having a visual barrier formed from an aesthetically pleasing material that provides a clean uniform appearance to the glazing unit.

One problem with the glazing units produced by these automated processes is that the desiccant matrix is pumped into the glazing units by sealant pumps. This process uses a relatively large amount of energy because the desiccant matrix may require heating prior to being pumped and the pumps require energy to operate. These pumps also wear out quickly because the desiccant is highly abrasive. The high energy use and frequent replacement and repair of the sealant pumps increases the cost of the automated process. It is thus desired in the art to provide a glazing unit and a method for manufacturing the glazing unit that does not require the desiccant matrix to be pumped in during the process. Another problem with the glazing unit described above is that some types of the desiccant matrix used inside the U-shaped spacer remain flowable after the glazing unit is fabricated. On hot days when the sun heats the interior of the glazing unit, the desiccant matrix may flow along the intermediate sheet and degrade the appearance of the glazing unit.

The automated process using the substantially U-shaped metal spacer has gained broad industry acceptance and is particularly successful with two-sheet glazing units. The automated process is capable of quickly and efficiently fabricating the two-sheet glazing units in a variety of sizes. The automated process has not, however, achieved great commercial success for glazing units that have more than two glazing sheets. This lack of commercial success is attributed to the fact that creating glazing units having more than two glazing sheets with the automated process is significantly more time consuming than the time that it takes to create a glazing unit having two glazing sheets. The increase in the amount of time to create the glazing unit is chiefly attributed to the fact that the intermediate glazing sheet must be precisely placed in the groove formed in the layer of pliable material on the first attempt. Such precise placement is especially difficult because the intermediate glazing sheets are positioned by hand. The difficulty of this task increases with the size of the glazing unit and the speed of the automated line. The intermediate glazing sheet must be precisely placed in the groove because it cannot be easily adjusted once its edge engages the pliable material. If the intermediate glazing sheet contacts the pliable material and is then removed, the pliable material must be cleaned from the edge of the glazing sheet prior to replacing the sheet in the spacer. Furthermore, some portions of the U-shaped spacer may be left without a sufficient amount of pliable material if enough of the pliable material adheres to the edge of the glazing sheet during the first attempt to place it in the spacer. It is thus desired in the art to provide an apparatus and method for assembling a glazing unit that decreases the difficulty in installing the intermediate glazing sheet and allows the position of the intermediate glazing sheet to be adjusted with respect to the spacer after it has been positioned.

Another undesirable aspect of the glazing unit disclosed in the patent is that the two cavities formed between the intermediate glazing sheet and the outer glazing sheets are sealed from each other by the interaction of the desiccant matrix and the intermediate glazing sheet. When the cavities are sealed from each other, the intermediate glazing sheet experiences stresses caused by changes in pressure in the individual cavities brought on by temperature changes and/or barometric changes. The force of wind against one of the outer glazing sheets can also alter the pressure in the individual cavities creating stresses on the intermediate glazing sheet. Past solutions to the problem of separately sealed cavities include providing a breathing tube between the cavities or drilling a hole in the intermediate glazing sheet to provide fluid communication between the cavities. It is, however, desirable to provide a spacer that receives an intermediate glazing sheet such that the two cavities formed by the intermediate glazing sheet and the outer glazing sheets are in fluid communication without requiring either of these past solutions.

Another limiting factor of the apparatus and method disclosed in the patent is that the position of the intermediate glazing sheet with respect to the outer glazing sheets is limited by the method disclosed in the patent. The intermediate glazing sheet is positioned through the cooperation of a pair of bent portions at the corners of the spacer with the pliable material such that the bent portions push the pliable material into the intermediate glazing sheet to center it within the spacer. This method of positioning does not easily allow the intermediate glazing sheet to be positioned closer to one of the outer glazing sheets than the other. The offset of the intermediate glazing sheet can provide an acoustic benefit to the glazing unit as well as positioning the intermediate glazing sheet away from the screw that holds the spacer together. It is thus desired in the art to provide an insert for the spacer of the above-described glazing unit that overcomes these deficiencies and problems created by the desiccant matrix.

SUMMARY OF THE INVENTION

It is thus an objective of the present invention to provide an insert for a glazing unit having substantially stable dimensions.

Another objective of the present invention is to provide an insert having an aesthetically pleasing appearance.

Another objective of the present invention is to provide an insert that may be formed in different colors to allow one to select the appearance of the glazing unit.

Still another objective of the present invention is to provide an insert that slidably receives an intermediate glazing sheet in a channel allowing the intermediate glazing sheet to be repositioned during assembly of the glazing unit allowing the glazing unit to be easily assembled.

Yet another objective of the present invention is to provide an insert that creates fluid communication between the cavities formed between the intermediate glazing sheet and the outer glazing sheets.

A further objective of the present invention is to provide an insert that increases the insulating properties of the edge assembly.

Still a further objective of the present invention is to provide an insert that may be configured allowing the intermediate glazing sheet to be positioned closer to one of the outer glazing sheets than the other to improve the sound barrier properties of the unit.

Another objective of the present invention is to provide an insert that may be configured to position the intermediate glazing sheet in a position that causes the screw that is used to hold the spacer together to avoid contacting the intermediate glazing sheet.

Yet a further objective of the present invention is to provide an insert that includes an outwardly facing channel that receives the screw used to hold the spacers together.

Another objective of the present invention is to provide an insert that includes inwardly facing thermal channels that increase the insulating properties of the edge assembly by lengthening the conductive path across the unit.

A further objective of the present invention is to provide an insert including a desiccant material that is in fluid communication with the cavities formed between the intermediate glazing sheet and the outer glazing sheets.

Another objective of the present invention is to provide an insert that is configured to be fabricated from a low volume of material while substantially blocking the view of the interior of the spacer while also holding the position of the intermediate glazing sheet.

A further objective of the present invention is to provide an insert that is configured to be flexible so that it may fit into a range of different-sized spacers.

Another objective of the present invention is to provide an insert for a glazing unit that includes the desiccant material in the insert so that the desiccant does not have to be pumped into the glazing unit by sealant pumps.

Another objective of the present invention is to provide an insert for a glazing unit that creates separate insulating air pockets inside the spacer.

Another objective of the present invention is to provide a method for assembling a glazing unit with the insert of the present invention.

Another objective of the present invention is to provide an insert for a glazing unit that is of simple construction, that achieves the stated objectives in a simple, effective, and inexpensive manner; and that solves the problems and that satisfies the needs existing in the art.

These and other objectives and advantages are obtained by the insert for a glazing unit having at least two outer glazing sheets separated by a substantially rigid, U-shaped spacer disposed about the perimeter of the sheets to create an interior cavity between the outer sheets and the spacer, the spacer having a longitudinal length dimension substantially equal to the perimeter of the glazing sheets; the general nature of the insert may be stated as including a body having a width and a height, the width and height of the body adapted to fit within the U-shaped spacer; the body having an inner surface, an outer surface, and a pair of side surfaces; the body having a longitudinal length dimension substantially equal to the length of the spacer; and the body being fabricated from a non-flowable material having substantially stable dimensions.

Other objectives of the present invention are achieved by a glazing unit including a pair of outer glazing sheets; an intermediate glazing sheet disposed between the outer glazing sheets; a spacer extending about the peripheries of the glazing sheets; an insert disposed within the spacer, the insert being fabricated from a non-flowable material having substantially stable dimensions; and the insert having at least one longitudinal, inwardly-facing glazing sheet-receiving channel, the intermediate glazing sheet being seated in the channel.

Still other objectives of the invention are achieved by a method for manufacturing a glazing unit including the steps of providing at least two outer glazing sheets and at least one intermediate glazing sheet; providing a U-shaped, substantially rigid spacer having a base with two spaced legs, the outer surface of the spacer being covered with an adhesive; inserting an insert into the spacer, the insert being fabricated from a non-flowable material having substantially stable dimensions; folding the U-shaped spacer around the other three sides of intermediate glazing sheet; placing the outer-glazing sheets on the frame such that the outer glazing sheets contact the adhesive; and pressing the outer glazing sheets towards each other to form a sealed glazing unit.

BRIEF DESCRIPTION OF THE DRAWINGS

The preferred embodiments of the invention, illustrative of the best modes in which Applicant contemplated applying the principles of the invention, are set forth in the following description and are shown in the drawings and are distinctly pointed out and set forth in the appended claims.

Similar numbers refer to similar parts throughout the application.

DESCRIPTION OF THE PREFERRED EMBODIMENTS

Figure 1:
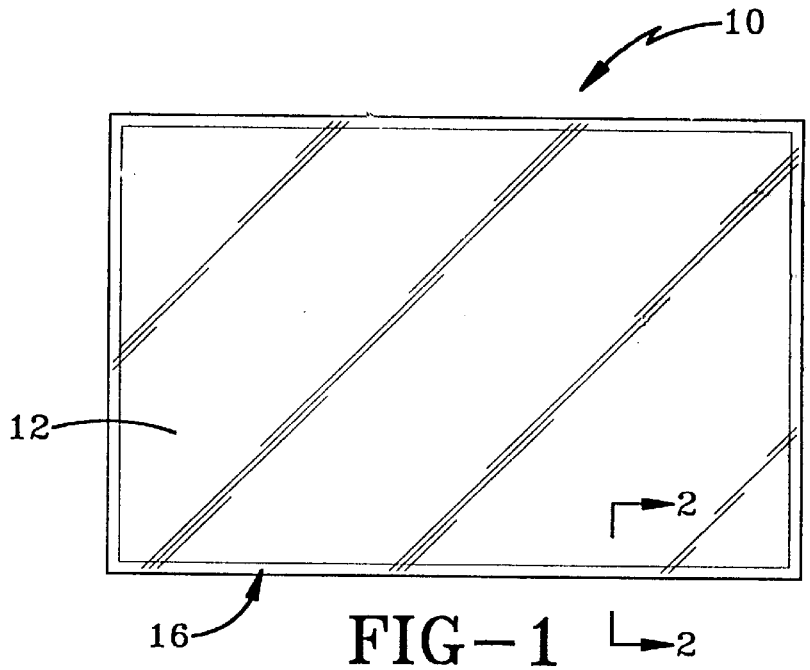
FIG. 1 is a front elevational view of a glazing unit incorporating the insert of the present invention.

A glazing unit utilizing an insert according to the present invention is depicted in FIG. 1 and is indicated generally by the numeral 10. Glazing unit 10 includes a pair of outer glazing sheets 12 and 14 separated by a U-shaped spacer 16. Spacer 16 is fabricated from a substantially rigid material such as metal, plastic, or oriented thermoplastic. Although plastic and thermoplastic have more desirable heat transfer characteristics than metal, metal may be less expensive to use and easier to form during an automated process than the plastics.

Spacer 16 includes a substantially planar base 18 with a pair of spaced, substantially parallel outer legs 20 extending from the outer edges of base 18. Each outer leg 20 includes a distal edge 22 and a proximal edge 24 with the proximal edge connected to base 18. An inwardly-extending lip 26 extends from distal edge 22 of each leg 20. Each lip 26 is sized to create a protuberance in the U-shaped channel of spacer 16 but is short enough to allow an insert 30 to be fit within the U-shaped channel.

Spacer 16 is held between outer glazing sheets 12 and 14 with an adhesive 32 that is disposed between each outer leg 20 and glazing sheets 12 and 14. Adhesive 32 also fills an outwardly facing channel formed between the outer surface 34 of spacer 16 and the inner surfaces 36 and 38 of outer glazing sheets 12 and 14. Adhesive 32 and spacer 16 cooperate to seal the interior cavity 40 of glazing unit 10 from the atmosphere outside glazing sheets 12 and 14. Cavity 40 may be filled with an inert gas that provides desirable heat transfer characteristics.

Insert 30 is fabricated from a non-flowable material such that it has substantially stable dimensions after it has been formed. Insert 30 may be manufactured from thermoplastic or thermosetting plastics. Suitable thermosetting plastics include silicone, EPDM, and polyurethane. Suitable thermoplastic materials include thermoplastic elastomers such as Santoprene, Kraton, or cross-linked polyethylene. One preferred material is silicone foam. The advantages of the silicone foam include: good durability, minimal outgassing, low compression set, good resilience, high temperature stability, and cold temperature flexibility. A further advantage of the silicone foam is that the material is moisture permeable such that moisture vapor can easily reach a desiccant material disposed within the foam or underneath the foam. Other significant advantages of silicone foam are that it is UV resistant and may be fabricated in a wide variety of different colors.

Figure 2:
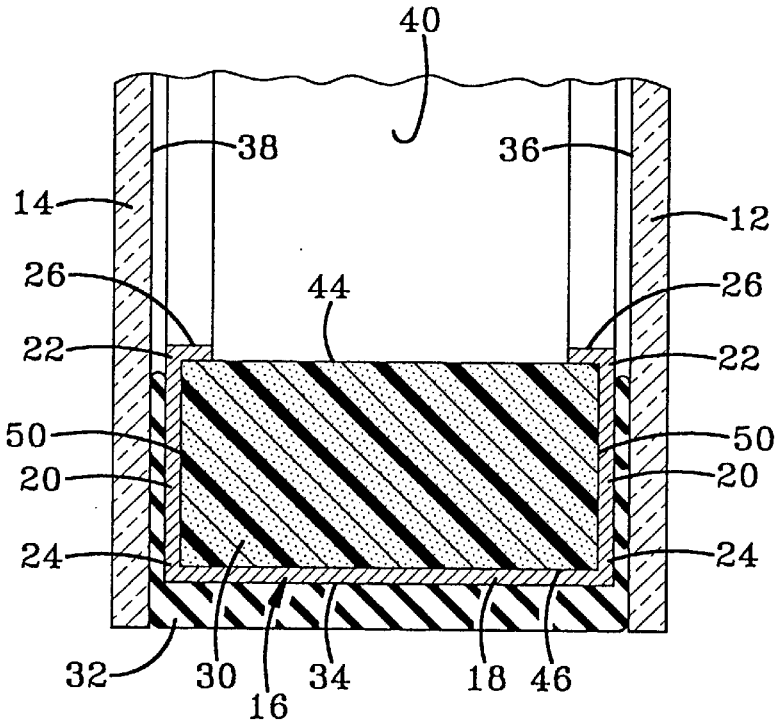
FIG. 2 is a sectional view taken along line 2—2 of FIG. 1.

In the embodiment of the invention depicted in FIG. 2, desiccant material 42 is added during the production of the foam as a fill. The type of desiccant material used may be any of the various desiccants known in the art. Overall, the amount of desiccant material to be used should match the amount of desiccant material that is typically incorporated in a conventional sealed glazing unit. In the embodiment of the invention depicted in FIG. 3, desiccant material 42 is dispersed as a layer between the outer surface 46 of insert 30 and inner surface 48 of spacer 16. The permeability of insert 30 allows desiccant material 42 to be in fluid communication with cavity 40. In the embodiment of the invention depicted in FIG. 4, desiccant material 42 is dispersed in a layer adjacent inner surface 44 of insert 30.

Figure 3:
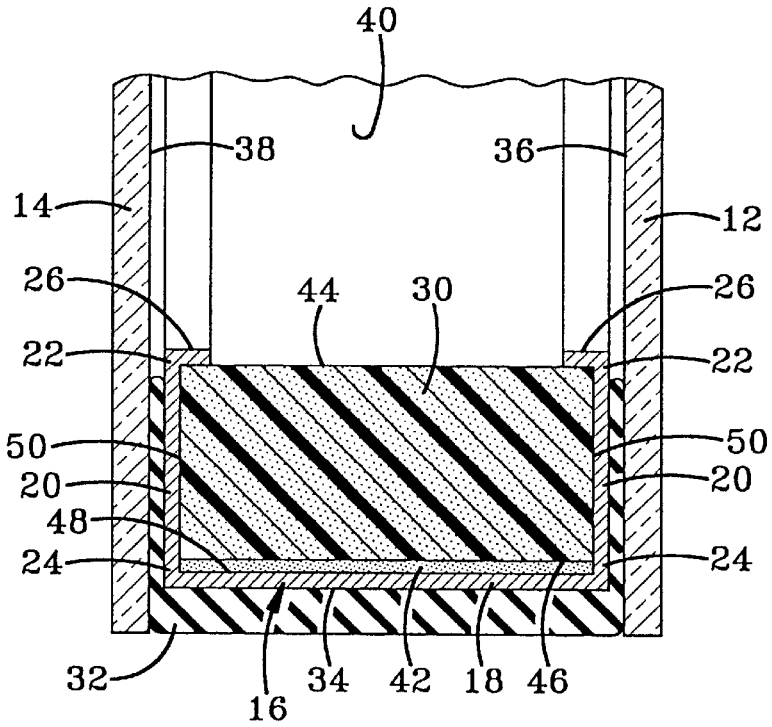
FIG. 3 is a sectional view similar to FIG. 2 showing an alternative embodiment of the invention.
Figure 4:
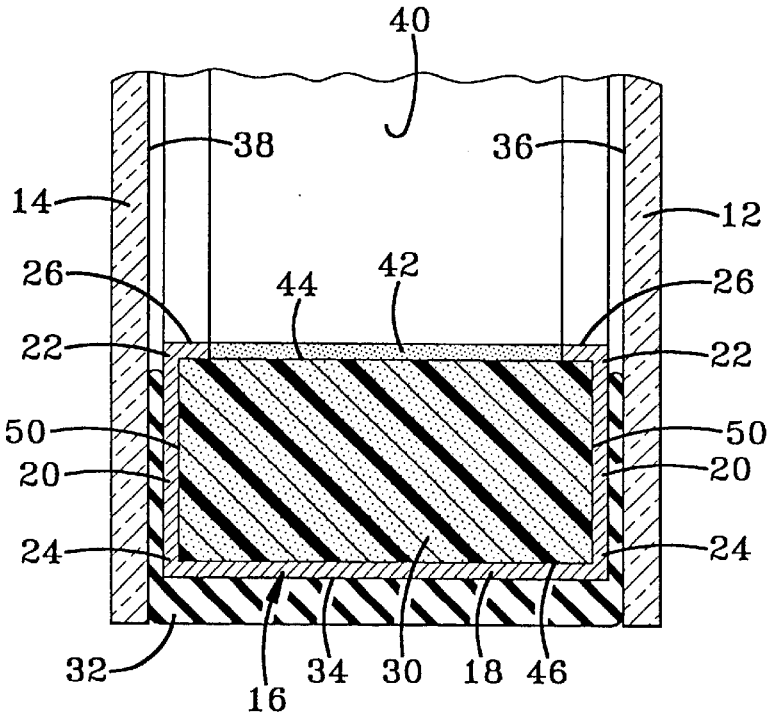
FIG. 4 is a sectional view similar to FIG. 2 showing another alternative embodiment of the invention.

In the embodiments of the invention depicted in FIGS. 2 through 4, insert 30 has a width substantially equal to the width of base 18 and a height substantially equal to outer legs 20 such that insert 30 fits snugly within U-shaped channel of spacer 16 but may slide with respect to the channel. Outer surface 46 and the side surfaces 50 of insert 30 are, however, substantially smooth and non-tacky such that they slidably engage the inner surfaces of spacer 16. Insert 30 may thus be installed by sliding it into spacer 16. Insert 30 may thus be adjusted within spacer 16 after it has been installed within spacer 16 by sliding it back and forth. Lips 26 engage inner surface 44 of insert 30 to retain insert 30 in spacer 16. Insert 30 is flexible enough to fit between lips 26 and resilient enough to spring back and substantially fill U-shaped channel of spacer 16.

Insert 30 improves the insulating properties of spacer 16 by substantially filling spacer 16 with a material that has desirable thermal properties. In the past, spacer 16 was not filled with a material that provided better thermal properties than the material filling cavity 40. Insert 30 improves the heat transfer characteristics of glazing unit 10 by improving the thermal performance of spacer 16.

Insert 30 also improves the visual appearance of the interior of spacer 16. Inner surface 44 of insert 30 provides a relatively smooth, clean surface to be viewed through outer glazing sheets 12 and 14. Insert 30 may be provided in a variety of colors that are more pleasing in appearance than the appearance of the interior of spacer 16. Insert 30 may be provided in a warm color that blocks the cold appearance of the metal of spacer 16 from view giving the consumer the appearance of a warm edge in glazing unit 10.

Figure 5:
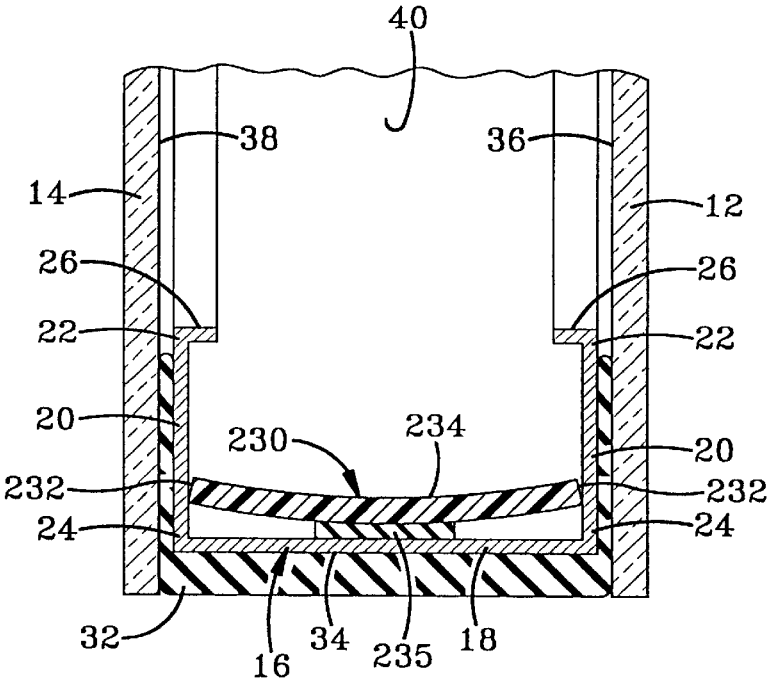
FIG. 5 is a sectional view similar to FIG. 2 showing an alternative embodiment of the invention positioned in the spacer of a glazing unit.
Figure 6:
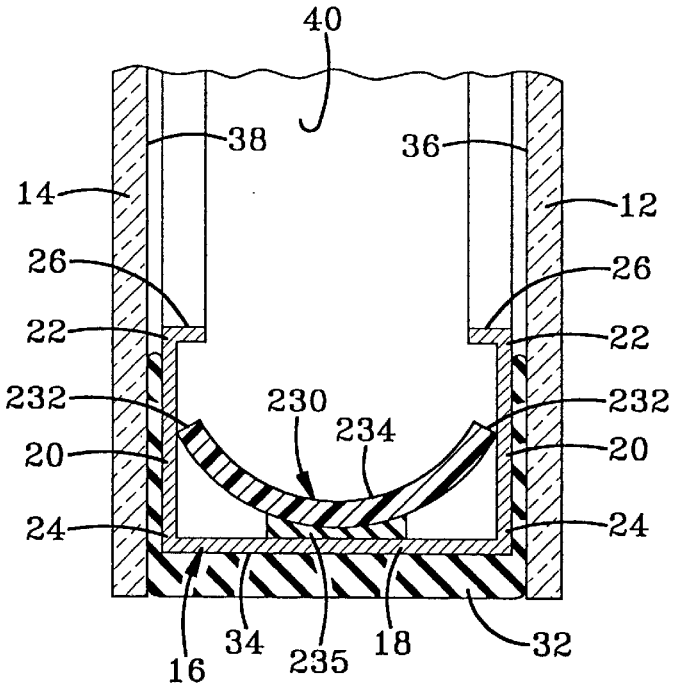
FIG. 6 is a sectional view similar to FIG. 5 showing the alternative embodiment of FIG. 5 positioned in a spacer smaller than the spacer of FIG. 5.

An alternative embodiment of the insert of the present invention is depicted in FIGS. 5 and 6 and is indicated generally by the numeral 230. Insert 230 is preferably fabricated from a material that is more dense and rigid than the materials from which insert 30 is fabricated. Insert 230 may be combined with any of the desiccant matrix positions depicted in FIGS. 2–4 and may preferably hold the desiccant within its perimeter.

As may be seen in FIGS. 5 and 6, insert 230 has a substantially rectangular cross section with a width that is substantially greater than its thickness. The width of insert 230 is adapted to fit within spacer 16 such that the edges 232 of insert 230 contact legs 20. The contact creates a frictional force between insert 230 and legs 20 that at least partially helps to hold the position of insert 230 with respect to spacer 16. The dimensions of insert 230 require it to be deformed before it can be placed in spacer 16. The material from which insert 230 is fabricated causes insert 230 to spring back toward its original shape when the force deforming insert 230 is removed. As such, insert 230 provides an outwardly directed force against each leg 20 once insert 230 is properly positioned.

The position of insert 230 is further held with respect to spacer 16 by a strip of adhesive 235 that is positioned between insert 230 and base 18 of spacer 16. Adhesive 235 may be connected to insert 230 when it is fabricated with a thin layer of material protecting its lower surface during storage and transport. The protective layer is then peeled off and discarded when insert 230 is installed into spacer 16. Any one of the numerous known adhesives may be used to perform this function.

Insert 230 improves the visual appearance of the interior of spacer 16 when insert 230 is installed in spacer 16. The inner surface 234 of insert 230 provides a relatively smooth, clean surface to be viewed through outer glazing sheets 12 and 14. Insert 230 may be provided in a variety of colors that are more pleasing in appearance that the appearance of the interior of spacer 16. Insert 230 may be preferably provided in a warm color that blocks the cold appearance of the metal of spacer 16.

Insert 230 may be fabricated from a significantly lower volume of material than insert 30. This aspect of insert 230 makes it inexpensive to fabricate in large quantities. Another desirable feature of insert 230 can be understood by comparing FIGS. 5 and 6. The spacer 16 of FIG. 6 has a width that is somewhat less than the width of spacer 16 in FIG. 5. Although the width of the spacers is different, the same size insert 230 may be used in both applications. The flexibility or bendability of insert 230 allows it to be used with spacers in a given size range. The upper limit of the size range is determined by the overall width of insert 230. A lower limit of the size range is determined by the point at which the bend in insert 230 causes damage to insert 230. This desirable aspect of insert 230 allows the manufacturer to keep an inventory and eliminates some of the expense of fabricating different sizes of insert 230. The window manufacturer also benefits by being able to keep fewer sizes of insert 230 on hand during the window fabrication process.

Figure 7:
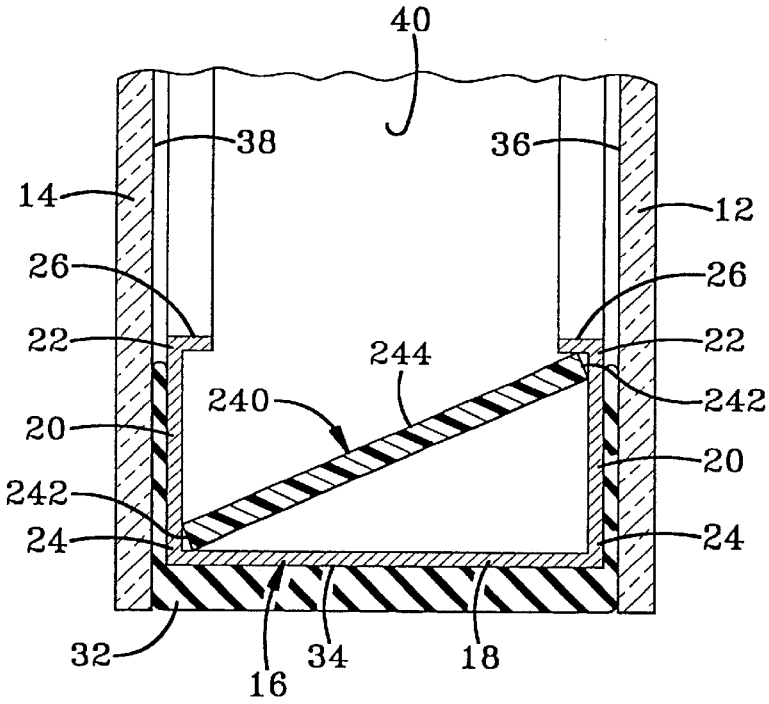
FIG. 7 is a sectional view similar to FIG. 2 showing an alternative embodiment of the insert of the invention positioned in a spacer.
Figure 8:
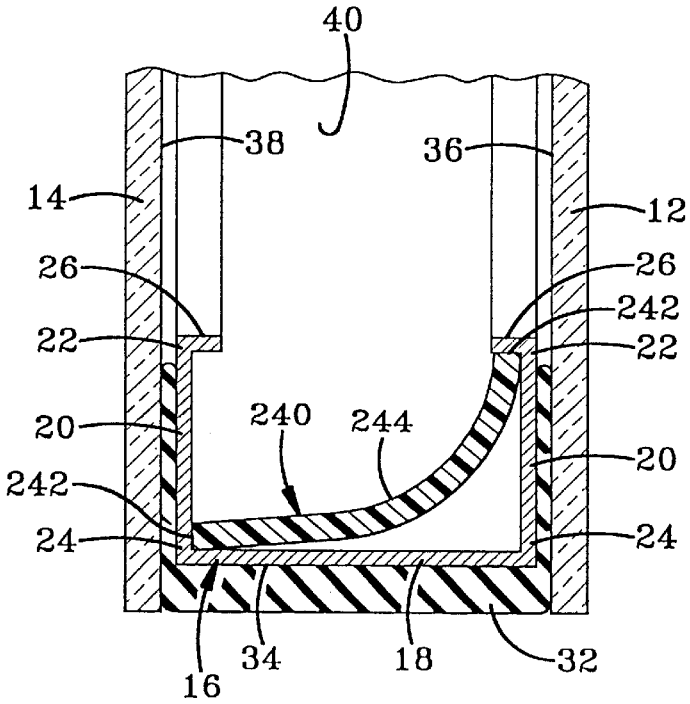
FIG. 8 is a view similar to FIG. 7 showing the alternative embodiment of FIG. 7 positioned in a smaller spacer than the spacer of FIG. 7.

An alternative embodiment of the insert of the present invention is depicted in FIGS. 7 and 8 and is indicated generally by the numeral 240. Insert 240 is preferably fabricated from the same material described above with respect to insert 230. Insert 240 may also be combined with any of the desiccant matrix positions depicted in FIGS. 2–4 and may preferably hold the desiccant within its perimeter.

As may be seen in FIGS. 7 and 8, insert 240 has a substantially rectangular cross section with a width that is substantially greater than its thickness. The width of insert 240 is adapted to cause insert 240 to fit within spacer 16 at an angle with the edges 242 of insert 240 disposed in opposite corners of spacer 16. Spacer 240 is thus held in position without the use of adhesive 235 or other connecting devices.

The dimensions of insert 240 require it to be deformed before it can be placed in spacer 16. The material from which insert 240 is fabricated causes insert to spring back towards its original shape when the force deforming insert 240 is removed. As such, insert 240 provides an outwardly directed force against each leg 20 once insert 240 is properly positioned.

Insert 240 improves the visual appearance of the interior of spacer 16 when insert 240 is installed in spacer 16. The inner surface 244 of insert 230 provides a relatively smooth, clean surface to be viewed through outer glazing sheets 12 and 14. Insert 240 may be provided in a variety of colors that are more pleasing in appearance than the appearance of the interior of spacer 16. Insert 240 may be preferably provided in a warm color that blocks the cold appearance of the metal spacer 16.

Insert 240 may be fabricated from a significantly lower volume of material than insert 230. As described above with respect to insert 230, the lower volume of material makes insert 240 relatively inexpensive to fabricate in large quantities and thus desired in the industry. Another similarity with respect to insert 230 is that insert 240 may be adapted to fit within spacers having different widths. This adaptability can be seen by comparing FIGS. 7 and 8 where FIG. 8 depicts insert 240 fit into a spacer 16 having a width that is somewhat smaller than the width of the spacer 16 depicted in FIG. 7. When insert 240 is placed in the smaller spacer 16, insert 240 is bent with its ends 242 remaining in the opposite corners of spacer 16.

Figure 9:
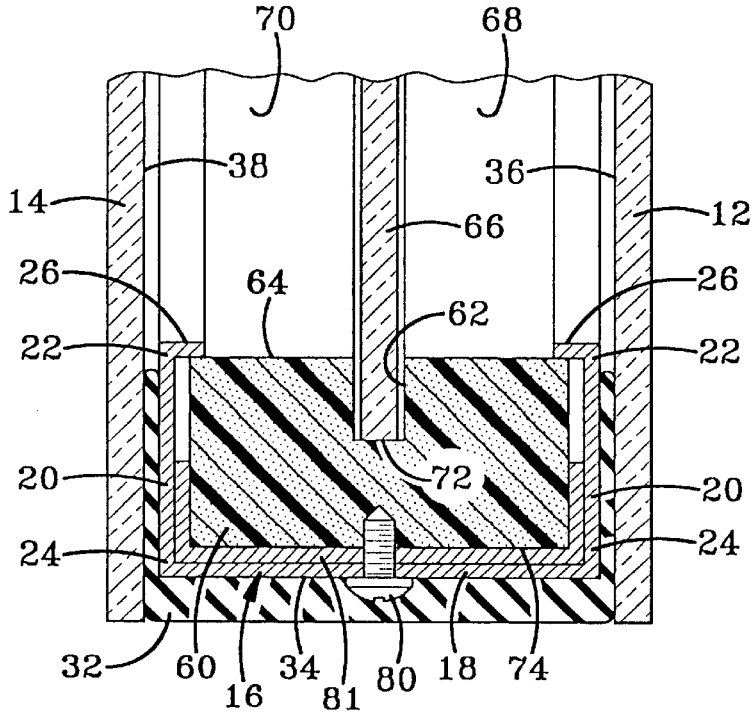
FIG. 9 is a sectional view similar to FIG. 2 showing an alternative embodiment of the insert having an inwardly facing glazing sheet-receiving channel seating an intermediate glazing sheet.

An alternative embodiment of the insert of the present invention is depicted in FIG. 9 and is indicated generally by the numeral 60. Insert 60 is fabricated from one of the same materials as insert 30 of FIGS. 2 through 4. Insert 60 may also be combined with any of the desiccant positions depicted in FIGS. 2–4. Insert 60 has an intermediate glazing sheet-receiving channel 62 formed in the inner surface 64 of insert 60. Channel 62 is longitudinally disposed in insert 60 and opens toward the interior of glazing unit 10. An intermediate glazing sheet 66 is disposed between outer glazing sheets 12 and 14 and is held in position by channel 62. The material from which insert 60 is fabricated is strong enough to support intermediate glazing sheet 66 without being crushed or deformed.

Intermediate glazing sheet 66 slidably engages channel 62 such that it may be positioned after it is installed within channel 62. The location of channel 62 also positions intermediate glazing sheet 66 at the desired location between outer glazing sheets 12 and 14. In the embodiment of the invention depicted in FIG. 9, channel 62 is centrally disposed in insert 60 such that intermediate glazing sheet 66 is disposed at an equal distance from either outer glazing sheet 12 or 14. Insert 60 prevents intermediate glazing sheet 66 from moving out of position within glazing unit 10 because the material has stable dimensions. The sidewalls of channel 62 cooperate to maintain the desired position of intermediate glazing sheet 66. Channel 62 may be configured to loosely receive intermediate glazing sheet 66 such that sheet 66 may be easily positioned and repositioned in channel 62. The width of channel 62 is greater than the thickness of intermediate glazing sheet 66 such that intermediate glazing sheet 66 may be easily fit into channel 62. The sidewalls of channel 62 may also be angled away from intermediate glazing sheet 66 to provide easy entry of intermediate glazing sheet 66 into channel 62. Channel 62 thus greatly decreases the difficulty in positioning intermediate glazing sheet 66 in spacer 16. A person using insert 60 can place intermediate glazing sheet 66 in channel 62 in any location and then slide it into the correct position. Sheet 66 may also be lifted out of channel 62 and repositioned without cleaning intermediate glazing sheet 66 because insert 60 is fabricated from a non-flowable material with stable dimensions.

Figure 17:
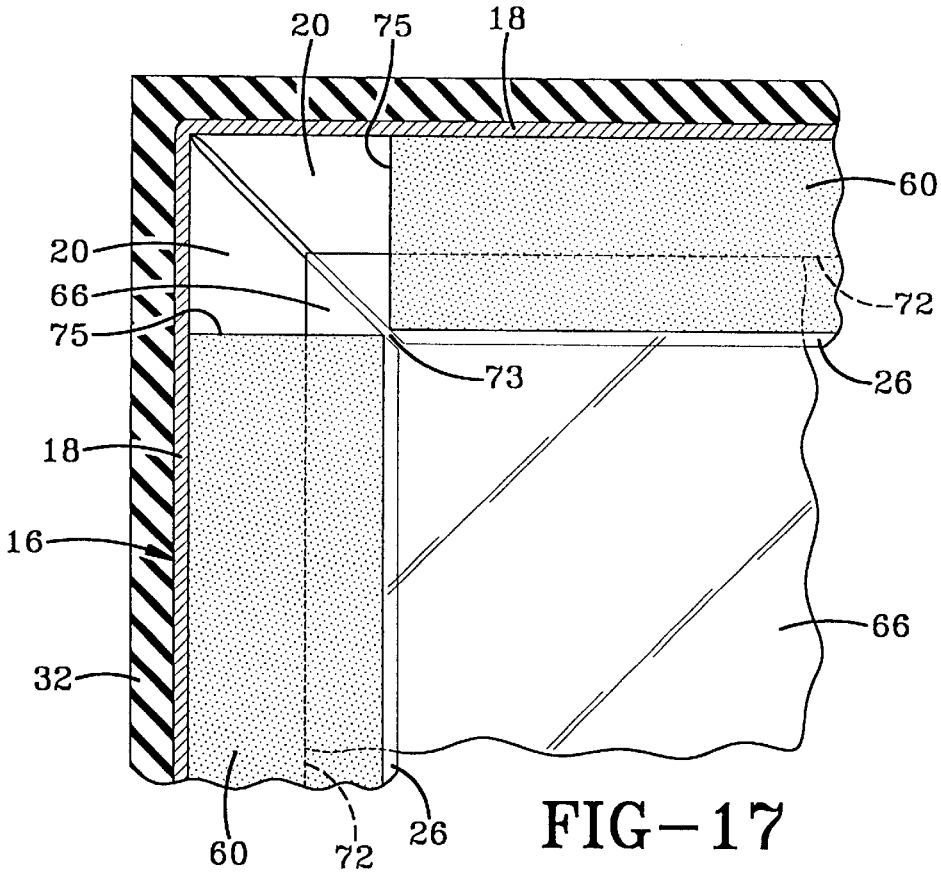
FIG. 17 is an enlarged elevational view of the final corner of the glazing unit with part of the spacer removed for clarity.
Figure 18:
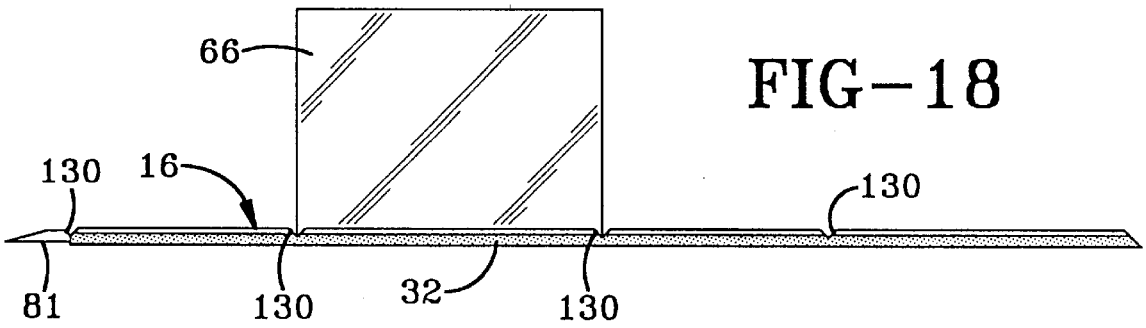
FIG. 18 is a schematic side view of an initial step in the assembly method of the present invention.
Figure 19:
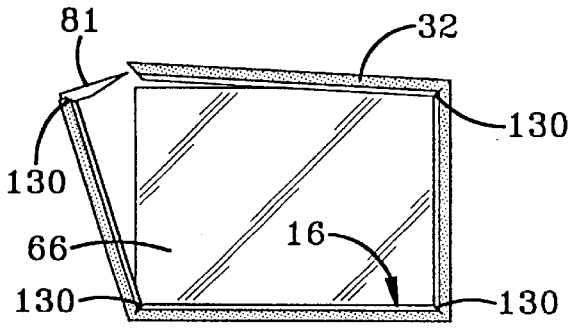
FIG. 19 is a schematic side view of another step of the assembly method of the present invention.
Figure 20:
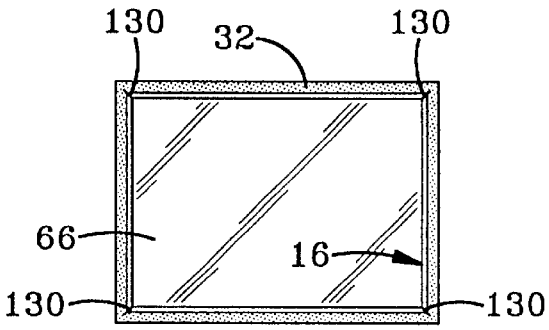
FIG. 20 is a schematic side view of yet another step of the assembly method of the present invention.
Figure 21:
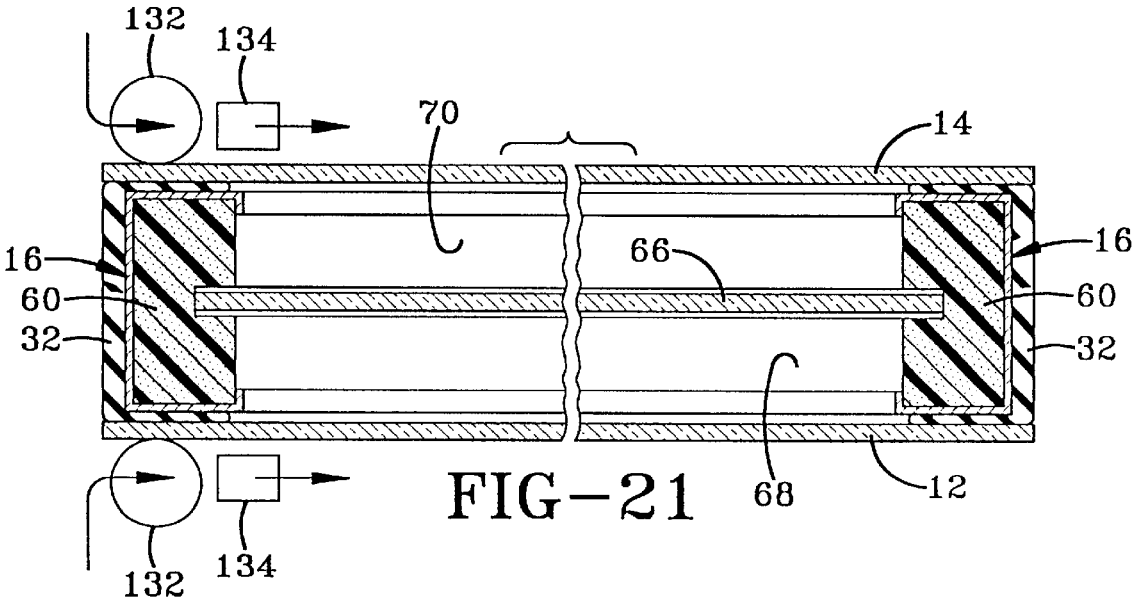
FIG. 21 is a schematic sectional view depicting still another step of the method of the present invention.

When positioned within channel 62, intermediate glazing sheet 66 forms a first cavity 68 between outer glazing sheet 12 and intermediate glazing sheet 66 and a second cavity 70 between outer glazing sheet 14 and intermediate glazing sheet 66. First cavity 68 is in fluid communication with second cavity 70 because intermediate glazing sheet 66 slidably engages channel 62 and allows fluid communication about its outer edge 72. First cavity 68 is also in fluid communication with the second cavity 70 because insert 60 does not extend continuously about the entire glazing unit 10. As such, a gap 73 is provided between the ends 75 of insert 60 that allows air to move freely between cavities 68 and 70. The air moves through gap 73 and around the corner of intermediate glazing sheet 66 as can be seen in FIG. 17. Such fluid communication allows the pressure in cavities 68 and 70 to be equalized.

Insert 60 also retains the characteristics of insert 30 in that insert 60 also slidably engages spacer 16. Insert 60 also improves the insulating properties of glazing unit 10 because intermediate glazing sheet 66 is separated from spacer 16 by a portion of insert 60 and thus does not contact metal. Furthermore, insert 60 provides a pleasing aesthetic appearance to glazing unit 10 by substantially filling spacer 16 around intermediate glazing sheet 66.

FIG. 9 also depicts a screw 80 that is used to assemble spacer 16. Spacer 16 is assembled by providing a tongue 81 on one end of spacer 16 that is slid back into spacer 16 so that the perimeter of spacer 16 may be fixed. Screw 80 extends through spacer 16 and through tongue 81 and into the body of insert 60. Once glazing unit 10 is completely assembled adhesive 32 completely surrounds the head of screw 80 to seal the hole in spacer 16. When screw 80 is inserted into spacer 16 and insert 60, the threads of screw 80 can damage insert 60. Screw 80 must thus be carefully inserted to avoid such damage. Screw 80 can also cause the material to bulge outwardly giving it an undesirable appearance. It is desired that insert 60 be configured such that no portion of screw plug 80 contacts intermediate glazing sheet 66 or extends completely into either cavity 68 or 70.

Figure 10:
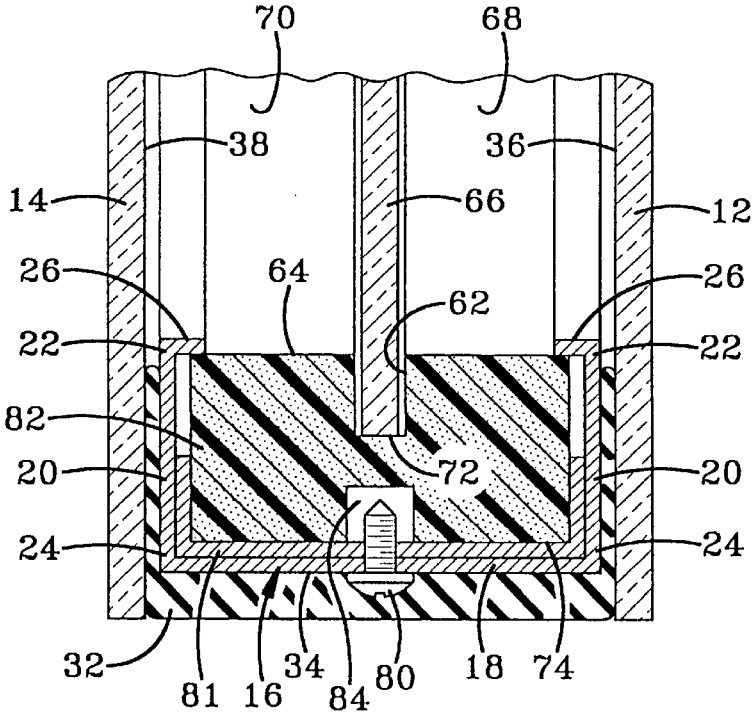
FIG. 10 is a view of an alternative embodiment of the insert depicted in FIG. 7 having an outwardly facing screw-receiving channel.

An alternative embodiment of insert 60 is depicted in FIG. 10 and is indicated by the numeral 82. Insert 82 includes inwardly facing, intermediate glazing sheet-receiving channel 62 in its inner surface 64. An intermediate glazing sheet 66 is received in channel 62 forming a first cavity 68 between intermediate glazing sheet 66 and outer glazing sheet 12 as well as a second cavity 70 between intermediate glazing sheet 66 and outer glazing sheet 14.

Insert 82 also includes an outwardly facing screw-receiving channel 84. Channel 84 also extends longitudinally through insert 82 and opens through outer surface 74 of insert 82. Channel 84 is sized and positioned to receive the threaded portion of screw 80.

Figure 11:
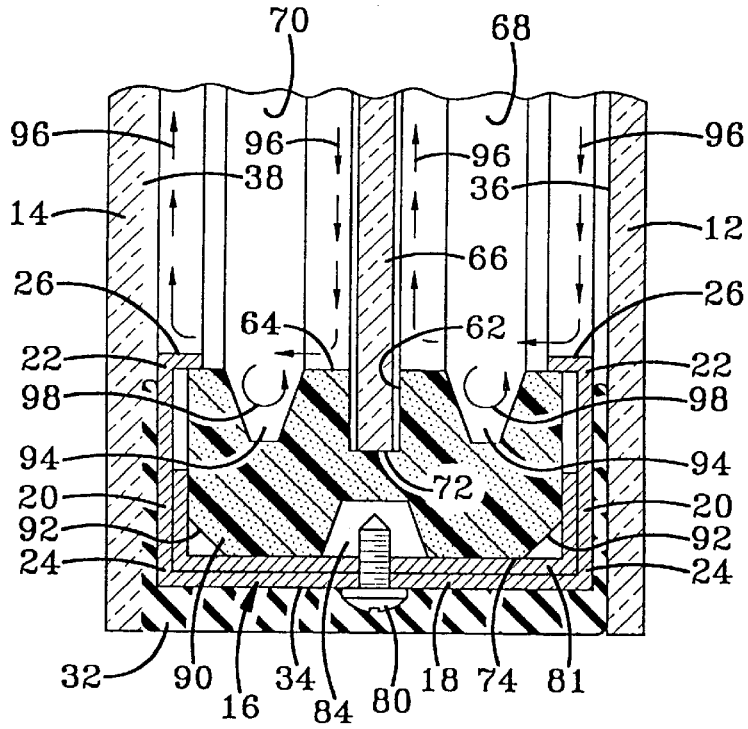
FIG. 11 is another alternative embodiment of the insert depicted in FIG. 10 having inwardly facing thermal channels.

Another alternative embodiment of an insert according to the present invention is depicted in FIG. 11 and is indicated by numeral 90. Insert 90 includes inwardly facing glazing sheet-receiving channel 62 in its inwardly facing surface 64. An intermediate glazing sheet 66 is received within channel 62 and is positioned by channel 62. Insert 90 further includes outwardly facing screw plug receiving channel 84 which receives the threaded portion of screw 80. In the embodiment of the invention depicted in FIG. 11, outwardly facing channel 84 has tapered sidewalls.

Insert 90 is configured to more easily fit within spacer 16. Outer corners 92 of insert 90 are chamfered to allow insert 90 to be fit more easily between lips 26 of spacer 16. Chamfered corners 92 also allow insert 90 to be formed with less material.

Insert 90 also includes a pair of thermal channels 94 that open into first and second cavities 68 and 70 through inner surface 64. In the embodiment of the invention depicted in FIG. 11, each thermal channel 94 is substantially V-shaped having a relatively flat lower surface. In other embodiments, thermal channels 94 may have different cross sections and need not be identically shaped. Thermal channels 94 improve the insulating characteristics of glazing unit 10 by providing a longer heat path and convection traps to glazing unit 10.

The convection traps function by interfering with the flow of cold air from one of outer glazing sheets 12 to the other of outer glazing sheets 14. For instance, the heat flow schematically depicted in FIG. 11 by the arrows labeled by numeral 96. As the heat flow travels down outer glazing sheet 12 and across inner surface 64 of insert 90, a portion of the cold air falls into thermal channel 94 and is trapped there as indicated by the arrow indicated by numeral 98. Thermal channels 94 increase the heat path of insert 90 by increasing the distance over inner surface of insert 90 from outer glazing sheet 12 to outer glazing sheet 14.

Figure 12:
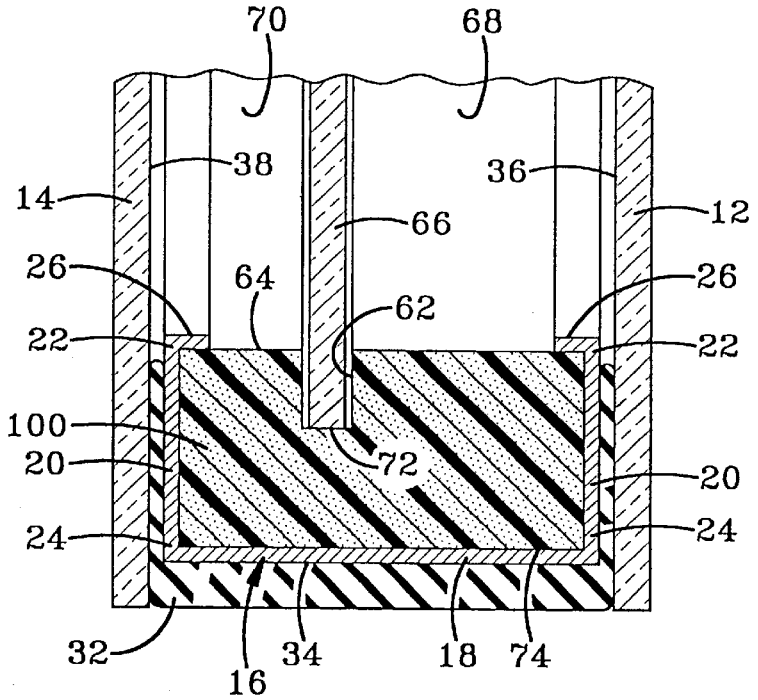
FIG. 12 is a view similar to FIG. 2 showing another alternative embodiment of the insert wherein the glazing sheet-receiving channel is positioned closer to one of the outer glazing sheets than the other.

Another embodiment of the insert of the present invention is depicted in FIG. 12 is indicated generally by the numeral 100. This embodiment is similar to the embodiment of the invention depicted in FIG. 9 except that inwardly facing channel 62 is non-centrally disposed in insert 100. Inwardly facing glazing sheet-receiving channel 62 is non-centrally disposed such that the width of cavity 68 is substantially greater than the width of second cavity 70. It is desirable to locate intermediate glazing sheet 66 a distance from the center of insert 100 to improve the sound barrier properties of glazing unit 10. An acoustic resonance may be prevented by positioning intermediate glazing sheet 66 off center.

Figure 13:
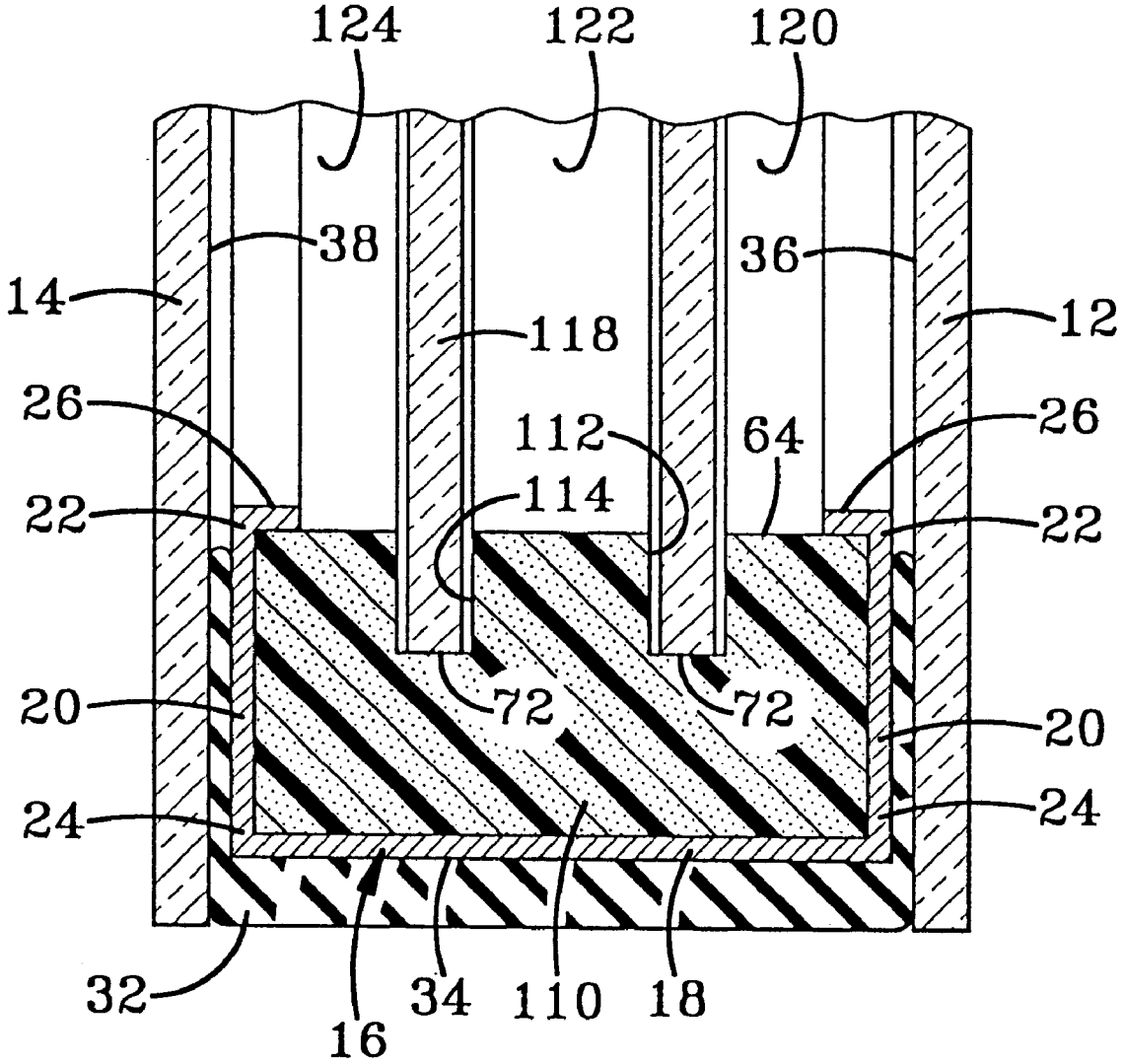
FIG. 13 is a view similar to FIG. 2 showing another alternative embodiment of the insert wherein the insert has a pair of inwardly facing glazing sheet-receiving channels in combination with a pair of intermediate glazing sheets.

Another embodiment of the insert of the present invention is depicted in FIG. 13 and is indicated by the numeral 110. Insert 110 is substantially similar to the other embodiments of the inserts described above. Insert 110, however, includes two inwardly facing sheet-receiving channels 112 and 114. An intermediate glazing sheet 116 and 118 is positioned within each inwardly facing channel 112 and 114. Intermediate glazing sheets 116 and 118 cooperate with outer glazing sheets 12 and 14 to form first, second, and third cavities 120, 122, and 124. The additional cavity provides an extra layer of insulation to glazing unit 10. The distances between channels 112 and 114 may also be altered to be unequal to provide improved acoustic properties to glazing unit 10. Insert 110 may also have outwardly facing channels (not shown) that may receive screws.

Figure 14:
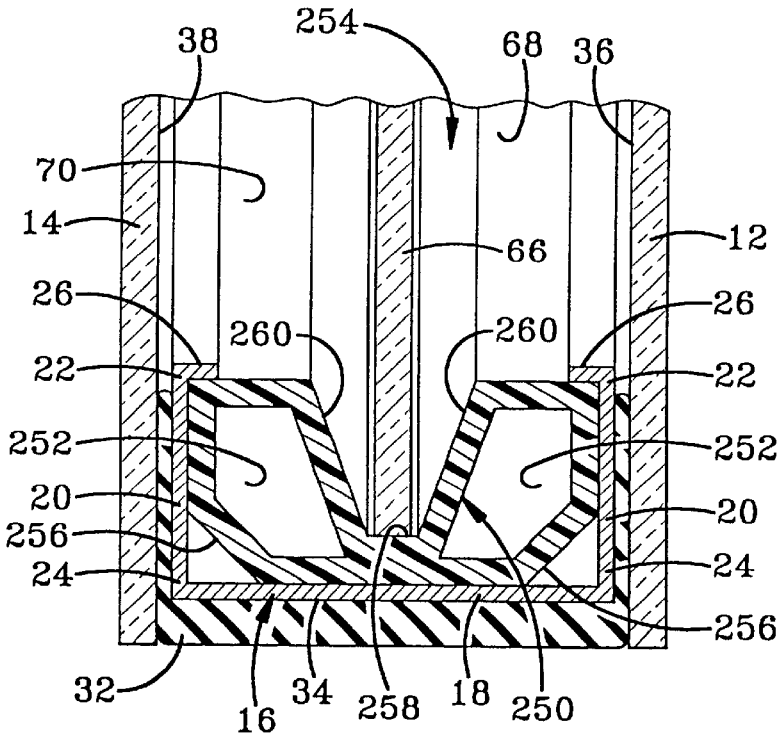
FIG. 14 is a view similar to FIG. 2 showing another alternative embodiment of the insert.

Another embodiment of the insert of the present invention is depicted in FIG. 14 and is indicated generally by the numeral 250. Insert 250 may be fabricated from the same foam material discussed above with respect to the other embodiments of the present invention or may be fabricated from a denser plastic as discussed with respect to the embodiment of the invention depicted in FIGS. 5 and 6. Insert 250 is designed to securely retain and position intermediate glazing sheet 66 within spacer 16 while being fabricated from a relatively low volume of material. To this end, a pair of large voids 252 are provided in insert 250 on either side of a sheet-receiving channel 254. Each void 252 substantially parallels the perimeter of insert 250 such that the wall thickness of insert 250 is substantially constant. In other embodiments of the present invention, voids 252 may be configured differently to provide different wall thickness where strength is required in insert 250. Voids 252 further provide insulating pockets in insert 250 that improve the thermal properties of insert 250.

Insert 250 is sized and adapted to fit snugly within spacer 16 where it is held by lips 26. The lower corners of insert 250 are chamfered with angled corners 256 to allow insert 250 to be more easily fit within spacer 16.

Sheet-receiving channel 254 includes a bottom wall 258 that is substantially parallel to base 18 of spacer 16. A pair of channel sidewalls 260 extend up from bottom wall 258 at angles. The angular disposition of sidewalls 260 make it easier for the user to install intermediate glazing sheets 66 in insert 250 during the manufacturing process. In other embodiments of insert 250, sheet-receiving 254 may have substantially parallel sidewalls.

Figure 15:
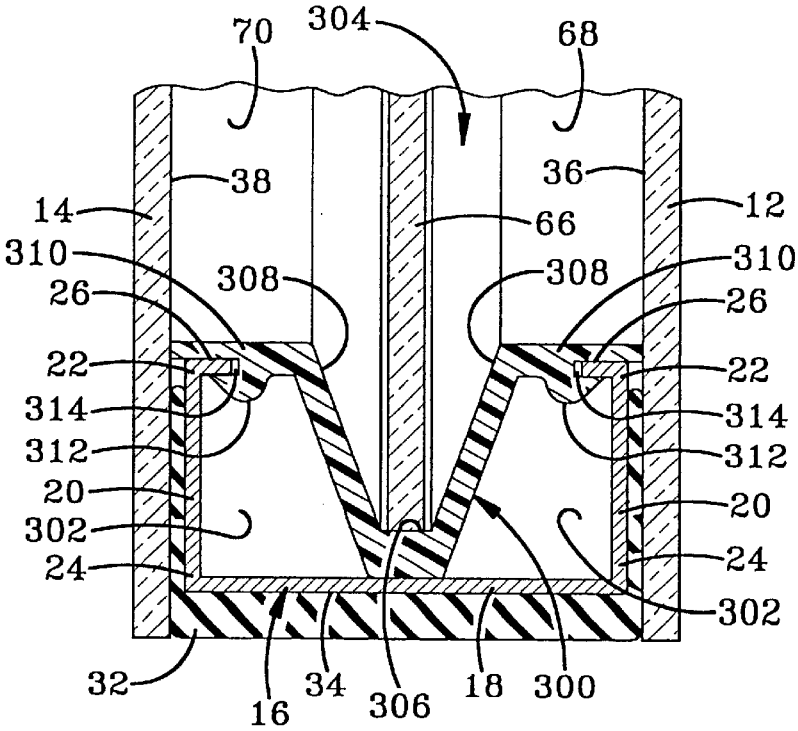
FIG. 15 is a view similar to FIG. 2 showing another alternative embodiment of the insert with retaining slots that connect the insert to the spacer.

Another embodiment of the insert of the present invention is depicted in FIG. 15 and is indicated generally by the numeral 300. Insert 300 may be fabricated from the same materials as in the embodiments described above but is preferably fabricated from a denser plastic such that a relatively low volume of material must be used to fabricate insert 300. Instead of the voids 252 as described above with respect to insert 250, insert 300 is supported on lips 26 of spacer 16 and leaves the large corner areas 302 unfilled. This configuration allows insert 300 to occupy a small volume while providing all of the benefits of the inserts described above. Insert 300 includes a sheet-receiving channel 304 that has a bottom wall 306 that is substantially parallel to base 18 of spacer 16. The sidewalls 308 of channel 304 are angled in the preferred embodiment to allow intermediate glazing sheet 66 to be easily positioned within channel 304 during the assembly process. In other embodiments of the present invention, side walls 308 may be substantially parallel. In yet other embodiments of the invention, side walls 308 may be angled at different angles to locate bottom wall 306 closer to one of glazing sheets 12 or 14 as desired to alter the acoustic properties of glazing unit 10.

Insert 300 extends above each lip 26 with a cover member 310. Each cover member 310 extends over the top of a lip 26 and continues out to inner surfaces 36 and 38 of outer glazing sheets 12 and 14. Cover member 310 thus prevents adhesive 32 from extending up past lips 26. Cover members 310 further prevent adhesive 32 from being viewed by the person looking into glazing unit 10.

Insert 300 further includes a pair of insert retaining members 312 that extend down from cover members 310 to latch around the lips 26. Cover members 310 and retaining members 312 are configured to provide an insert retaining slot 314 that is sized and configured to receive a lip 26 to securely anchor insert 300 within spacer 16.

Figure 16:
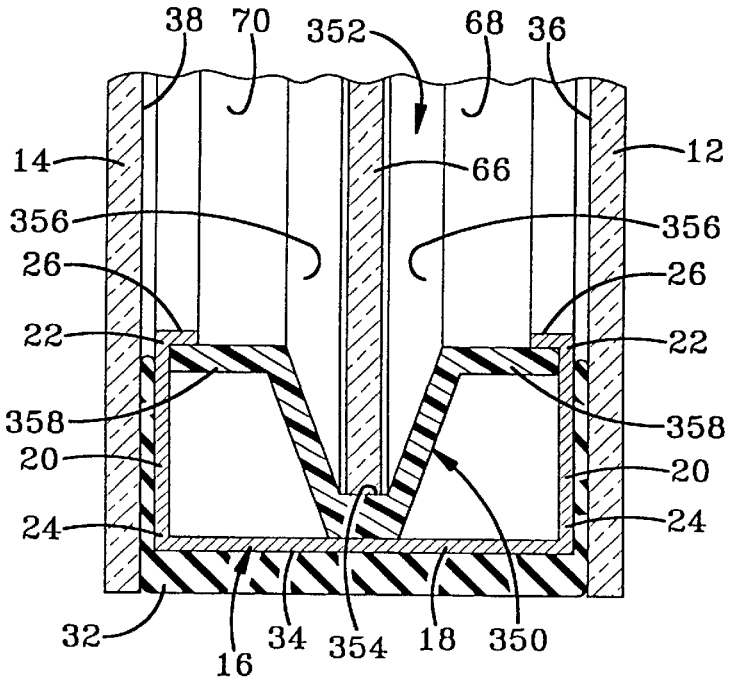
FIG. 16 is a view similar to FIG. 2 showing another alternative embodiment of the insert.

Another embodiment of the insert of the present invention is depicted in FIG. 16 and is indicated generally by the numeral 350. Insert 350 may be fabricated from any of the materials discussed above but is preferably fabricated from a denser plastic having a memory such that it springs back to its original position. Insert 350 includes an angled sheet-receiving channel 352 that includes a bottom wall 354 and a pair of angled side walls 356. As discussed above, angled side walls 356 may extend from bottom wall 354 at equal or unequal angles to position intermediate glazing sheets 66 in its desired location.

Insert 350 includes a pair of top walls 358 that are disposed substantially parallel to base 18 in the embodiment of the invention depicted in FIG. 16. Upper walls 358 are configured to fit under lips 26 to retain insert 350 within spacer 16. Insert 350 is further configured to flex and fit within a range of different sized spacers as discussed above with respect to insert 230 discussed above with respect to FIGS. 5 and 6. Thus, insert 350 may be inserted into a spacer 16 having a smaller width than the spacer 16 depicted in FIG. 16. When this occurs, upper walls 358 move toward each other and change the angle of each side wall 356 with respect to bottom wall 354. It is intended that insert 350 only be used in spacers 16 of sizes that prevent side walls 356 from pinching intermediate glazing sheets 66 when insert 350 is installed in spacer 16.

All of the embodiments of the inserts of the present invention described above are configured to slidably engage spacer 16 so that their position may be adjusted in spacer 16 after they have been installed. Further, each of the inserts may contain desiccant material, may be used with a desiccant material disposed along their inner surfaces 64 or their outer surfaces 74. Each insert may also be fabricated from a foam or a dense material.

Glazing unit 10 is assembled by first providing a pair of outer glazing sheets 12 and 14 and a U-shaped, substantially rigid spacer 16. The length of spacer 16 is somewhat longer than the perimeter of outer glazing sheets 12 and 14. The extra length is caused by tongue 81 that allows spacer 16 to be folded back into itself to secure its location. The outer surfaces of spacer 16 are then coated with adhesive 32. An insert 30 having a length substantially equal to the perimeter of outer glazing sheets 12 and 14 may then be inserted into spacer 16 manually or automatically. The length of insert 30 may be sized as to not extend into the corners of unit 10. The length may also be such that insert 30 is continuous through the corners of unit 10. When an intermediate glazing sheet 66 is desired, a different insert embodiment, such as insert 60 having the inwardly-facing longitudinal glazing sheet-receiving channel 62 is used. Spacer 16 is provided with a series of cutouts 130 that are adapted to allow spacer 16 to be folded about corners of glazing sheet 66.

Intermediate glazing sheet 66 is then placed in sheet-receiving channel 62 while insert 60 is received in spacer 16. After intermediate glazing sheet 66 is placed in insert 60, its exact position may be manipulated by sliding intermediate glazing sheet 66 in insert 60. The position of intermediate glazing sheet 66 must be manipulated such that it is disposed between two sets of cutouts 130 so that spacer 16 may be folded about the corners of intermediate glazing sheet 66. Spacer 16 and insert 60 are then wrapped around the other three sides of intermediate glazing sheet 66 so that it substantially surrounds intermediate glazing sheet 66. Spacer 16 is then assembled with tongue 81 and screw 80.

Outer glazing sheets 12 and 14 are then positioned adjacent spacer 16 where adhesive 32 is disposed between glazing sheets 12 and 14 and spacer 16. Outer glazing sheets 12 and 14 are permanently attached to spacer 16 by passing outer glazing sheets 12 and 14 and spacer 16 through a heated roller press where a pair of rollers 132 apply force to outer glazing sheets 12 and 14 in combination with heat 134 to permanently bond outer glazing sheets 12 and 14 to spacer 16. Any insert described above may be used.

Accordingly, the improved insert for a glazing unit is simplified, provides an effective, safe, cost effective, and efficient device that achieves all the enumerated objectives of the invention, provides for eliminating difficulties encountered with prior devices and methods, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the insert for a glazing unit is constructed and used, the characteristics of the construction, and the advantageous new and useful results obtained; the new and useful structures, devices, elements, arrangements, parts, and combinations are set forth in the appended claims.

What is claimed is:

1. An insert for a glazing unit having at least two outer glazing sheets separated by a substantially rigid, U-shaped spacer disposed about the perimeter of the sheets to create an interior cavity between the outer sheets and the spacer; the spacer having an interior width and an interior height defining upper and lower corners and a lower wall; the insert comprising:

a body having a width, a height, and a longitudinal length; said width and height of said body adapted to fit within the U-shaped spacer;

the width and height of the body being adapted to cause the body to be positioned adjacent at least one upper corner and adjacent the lower wall; and said body being fabricated from a non-flowable material having substantially stable dimensions.

2. The insert of claim 1, wherein said body defines at least one intermediate glazing sheet-receiving channel; the sheet-receiving channel being longitudinally disposed and adapted to face the interior cavity; the sheet-receiving channel adapted to receive an intermediate glazing sheet.

3. The insert of claim 2, wherein the sheet-receiving channel has a depth and a width, said width of said sheet-receiving channel being adapted to be larger than the thickness of the intermediate glazing sheet in the channel.

4. The insert of claim 1, wherein the body defines an intermediate glazing sheet-receiving channel; the intermediate glazing sheet-receiving channel being adapted to receive an edge of an intermediate glazing sheet; the intermediate glazing sheet-receiving channel being at least partially defined by a pair of angled sidewalls.

5. The insert of claim 4, wherein the angled sidewalls are disposed on opposite sides of the channel.

6. The insert of claim 5, wherein the intermediate glazing sheet-receiving channel is centrally disposed in the body.

7. The insert of claim 5, wherein the intermediate glazing sheet-receiving channel is non-centrally disposed in the body.

8. The insert of claim 1, wherein the body defines at least one longitudinal void.

9. The insert of claim 1, wherein the body includes at least one retaining member; the retaining member being adapted to engage the U-shaped spacer.

10. The insert of claim 9, wherein the body includes a cover member that cooperates with each retaining member.

11. The insert of claim 1, wherein the body defines at least one inwardly-facing thermal channel disposed longitudinally in the body.

12. The insert of claim 11, wherein the thermal channel is V-shaped.

13. The insert of claim 11, wherein the body defines a second thermal channel disposed longitudinally in the body.

14. The insert of claim 1, wherein the body has a cross-section that is substantially V-shaped.

15. The insert of claim 1, wherein the body substantially fills the U-shaped spacer.

16. The insert of claim 1, wherein the body has a width and height adapted to cause the body to extend from one of the upper corners to one of the lower corners of the spacer.

17. The insert of claim 16, wherein the body is curved.

18. An insert for a glazing unit having at least two outer glazing sheets separated by a substantially rigid, U-shaped spacer disposed about the perimeter of the sheets to create an interior cavity between the outer sheets and the spacer; the spacer having an interior width and an interior height; the insert comprising:

a body having a width and a height;

said body being adapted to fit within the U-spacer; and said body defining at least one longitudinal void.

19. The insert of claim 18, wherein the body is fabricated from a non-flowable material having substantially stable dimensions.

20. The insert of claim 18, wherein the body is fabricated from a cured foam.

21. The insert of claim 18, wherein the body defines an intermediate glazing sheet-receiving channel; said sheet-receiving channel being longitudinal and disposed to face the interior cavity; said sheet-receiving channel being adapted to receive the edge of an intermediate glazing sheet.

22. The insert of claim 21, wherein the sheet-receiving channel is defined by a pair of angled sidewalls.

23. An insert for a glazing unit having at least two outer glazing sheets separated by a substantially rigid, U-shaped spacer disposed about the perimeter of the sheets to create an interior cavity between the outer sheets and the spacer; the U-shaped spacer having an interior width and an interior height; the insert comprising:

a body having a width and a height;

the body being adapted to fit within the U-shaped spacer; and the body having a cross-section that is substantially V-shaped.

24. The insert of claim 23, wherein the height of the body is adapted to be substantially equal to the interior height of the U-shaped spacer.

25. The insert of claim 23, wherein the body includes at least one retaining member; the retaining member being adapted to engage the U-shaped spacer.

26. The insert of claim 25, wherein the body includes a cover member cooperating with each retaining member.

27. The insert of claim 23, wherein the body is fabricated from a non-flowable material having substantially stable dimensions.

28. The insert of claim 27, wherein the body is fabricated from a cured foam.

* * * * *